US006968789B2

(12) United States Patent
Baik et al.

(10) Patent No.: US 6,968,789 B2
(45) Date of Patent: Nov. 29, 2005

(54) FOLDING TABLE WITH CENTRAL SUPPORT ASSEMBLY

(75) Inventors: Kwang-Ho Baik, Sungnam (KR); Jeffrey A. Fox, Sunnyvale, CA (US)

(73) Assignee: Lifetime Products, Inc., Clearfield, UT (US)

( * ) Notice: Subject to any disclaimer, the term of this patent is extended or adjusted under 35 U.S.C. 154(b) by 172 days.

(21) Appl. No.: 10/315,290

(22) Filed: Dec. 9, 2002

(65) Prior Publication Data

US 2003/0127028 A1 Jul. 10, 2003

Related U.S. Application Data

(60) Provisional application No. 60/339,210, filed on Dec. 10, 2001.

(51) Int. Cl.[7] ..... A47B 3/00
(52) U.S. Cl. ..... 108/132
(58) Field of Search ..... 108/132, 129, 108/131, 161, 130; 248/188.6

(56) References Cited

U.S. PATENT DOCUMENTS

| | | | | |
|---|---|---|---|---|
| 5,271,338 | A | 12/1993 | Bonham | |
| 5,357,872 | A | 10/1994 | Wilmore | |
| 5,421,272 | A | 6/1995 | Wilmore | |
| 5,694,865 | A | 12/1997 | Raab | |
| 5,732,637 | A | 3/1998 | Raab | |
| 5,868,081 | A | 2/1999 | Raab | |
| 6,112,674 | A * | 9/2000 | Stanford | 108/132 |
| 6,615,743 | B2 * | 9/2003 | Nien | 108/132 |
| 6,622,644 | B2 * | 9/2003 | Buono | 108/132 |
| 6,752,091 | B2 * | 6/2004 | Glover et al. | 108/132 |

* cited by examiner

*Primary Examiner*—Jose V. Chen
(74) *Attorney, Agent, or Firm*—Workman Nydegger

(57) ABSTRACT

A folding table (10) having a table top (14) and a support frame (12) which includes a perimeter frame assembly (41) and a central support/pivot assembly (26). The perimeter frame assembly (41) includes first (20) and second leg assemblies (22) which are pivotally attached to said the central support/pivot assembly (26). Also a frame (12) for a folding table (10).

24 Claims, 9 Drawing Sheets

FOLDING TABLE WITH CENTRAL SUPPORT ASSEMBLY

This application claims priority from U.S. provisional application Ser. No. 60/339,210, filed Dec. 10, 2001.

TECHNICAL FIELD

The present invention relates generally to folding tables, and more particularly to portable tables having collapsible leg assemblies.

BACKGROUND ART

Folding tables have traditionally been used at social functions and church socials because of their capacious size when erected, and their compact size when folded for storage. Such tables naturally have competing goals of providing stability and the goal to minimize weight. Older tables used particle board or masonite which tended towards sturdy construction, but at the expense of weight. More recently, tables have been constructed of blow-molded materials with a metal frame leg assembly attached to its underside. Such a table is shown in U.S. Pat. No. 6,112,674 to Stanford. This patent discloses a portable folding utility table having a center support assembly, which takes the form of a single cross-brace member to which two support braces are pivotally attached. This configuration does have the advantage of being more light-weight than previous folding tables There are disadvantages with this type of configuration. A surface supported only by a frame near the periphery and by one central cross member can be expected to sag in the regions between the central cross member and the peripheral frame.

Thus there is a need for a folding table which has improved central support and stability, while still remaining light in weight, and easily portable.

DISCLOSURE OF INVENTION

Accordingly, it is an object of the present invention to provide a table which is very light-weight and portable.

Another object of the invention is to provide a folding table which has improved stability and which provides a flat and even upper surface.

And another object of the invention is to provide a folding table that has improved support in the central region of the table.

A further object of the present invention is to provide a folding table which is very easy to assemble and disassemble.

Briefly, one preferred embodiment of the present invention is a folding table having a table top and a support frame which includes a perimeter frame assembly and a central support/pivot assembly. The perimeter frame assembly includes first and second leg assemblies which are pivotally attached to said the central support/pivot assembly. Also disclosed is a frame for a folding table.

An advantage of the present invention is that the central region of the table is supported in a very even and stable manner.

Another advantage of the present invention is that it is very light in weight, yet very strong and sturdy.

And another advantage of the present invention is that since both legs are independently mounted to the central support assembly, they may be individually more easily replaced or repaired.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
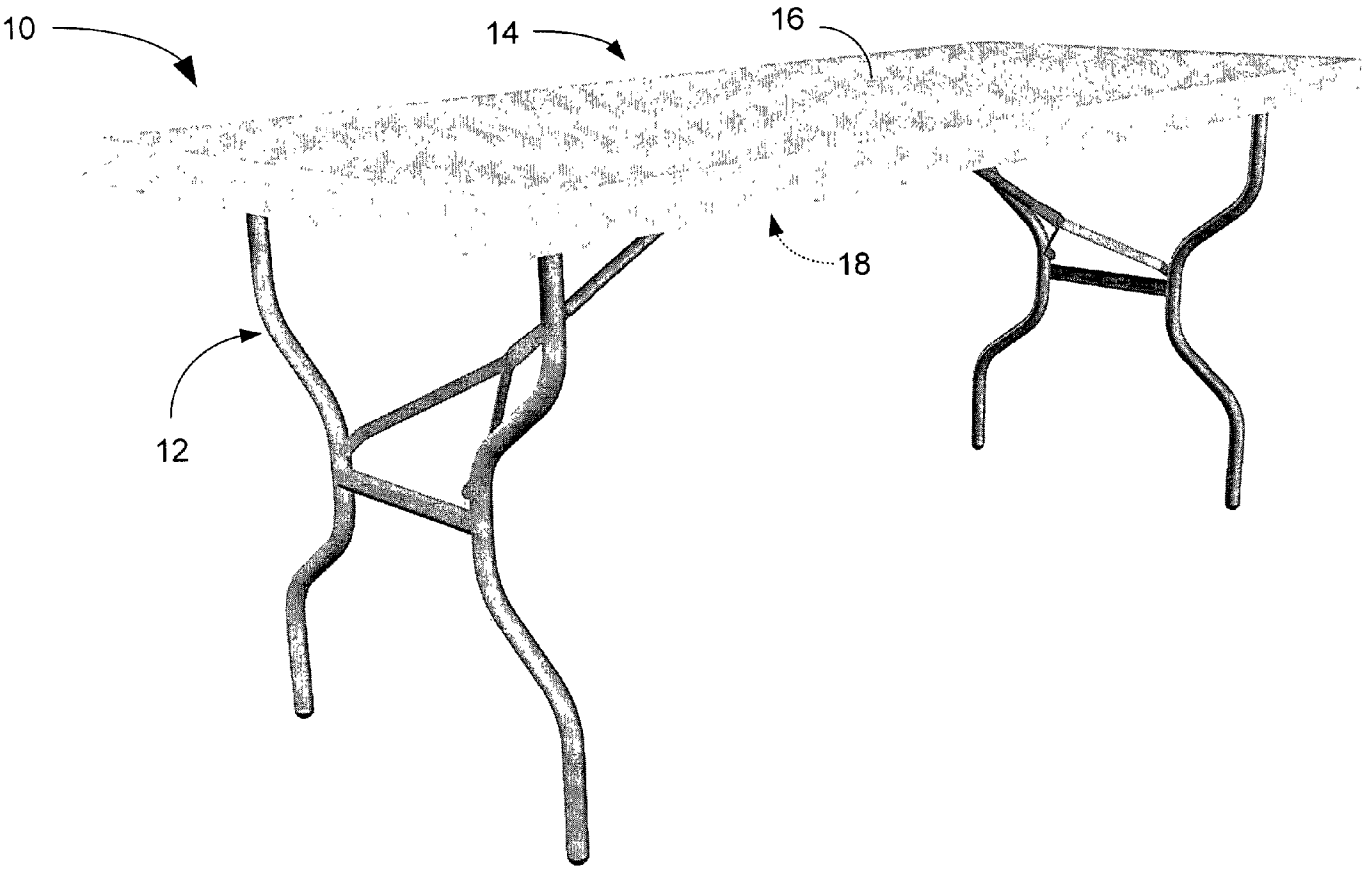
FIG. 1 shows a top perspective view of the table of the present invention.

A preferred embodiment of the present invention is a folding table with a double rail central support. As illustrated in the various drawings herein, and particularly in the view of FIG. 1, a form of this preferred embodiment of the inventive device is depicted by the general reference character 10.

Figure 2:
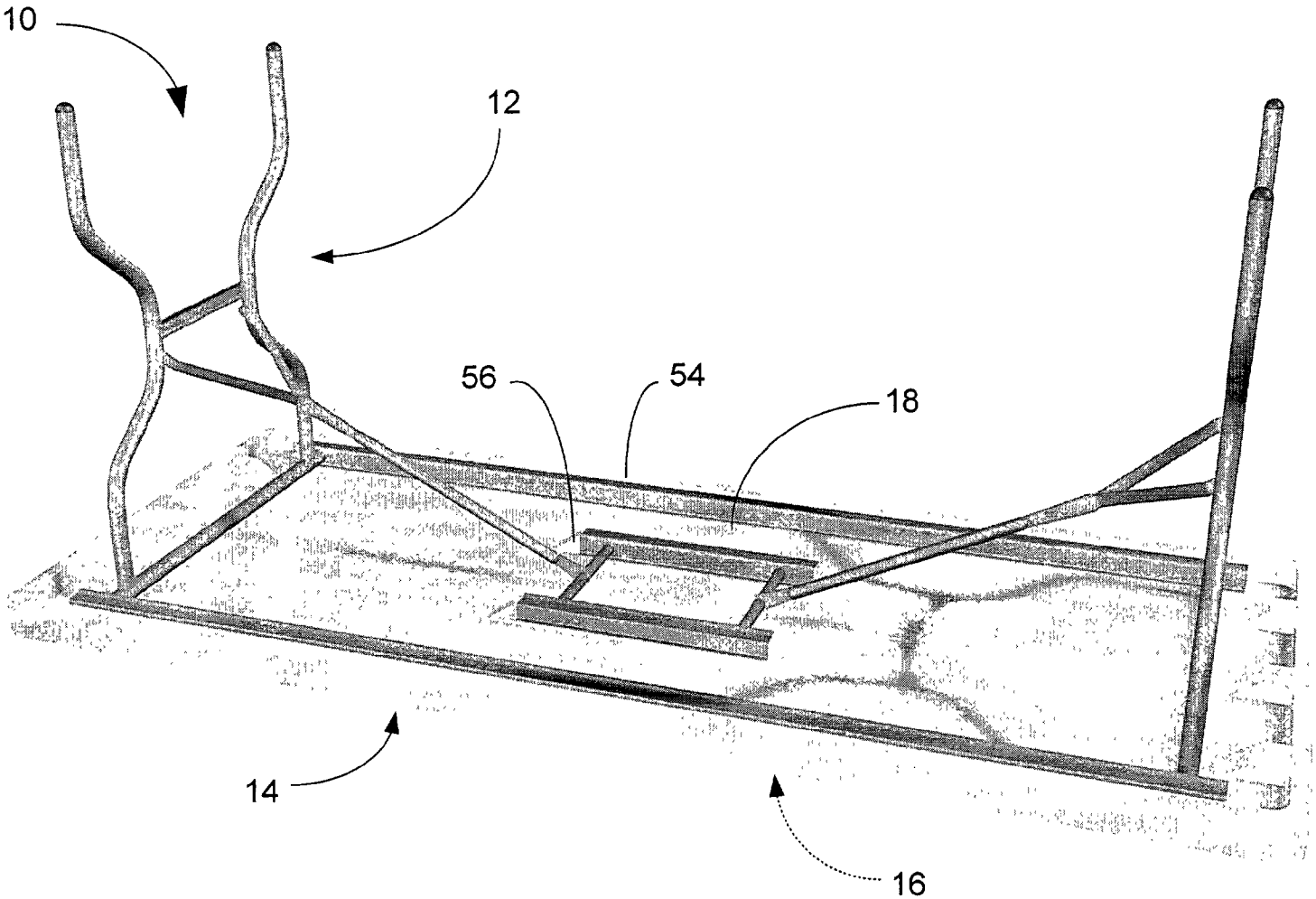
FIG. 2 illustrates a bottom perspective view of the table of the present invention.

FIGS. 1 and 2 show perspective views of the table from above and from the underside respectively of the folding table 10. The folding table 10 generally includes a support frame 12 and a table top 14. The table top 14 includes an upper surface 16 and a lower surface 18.

Figure 3:
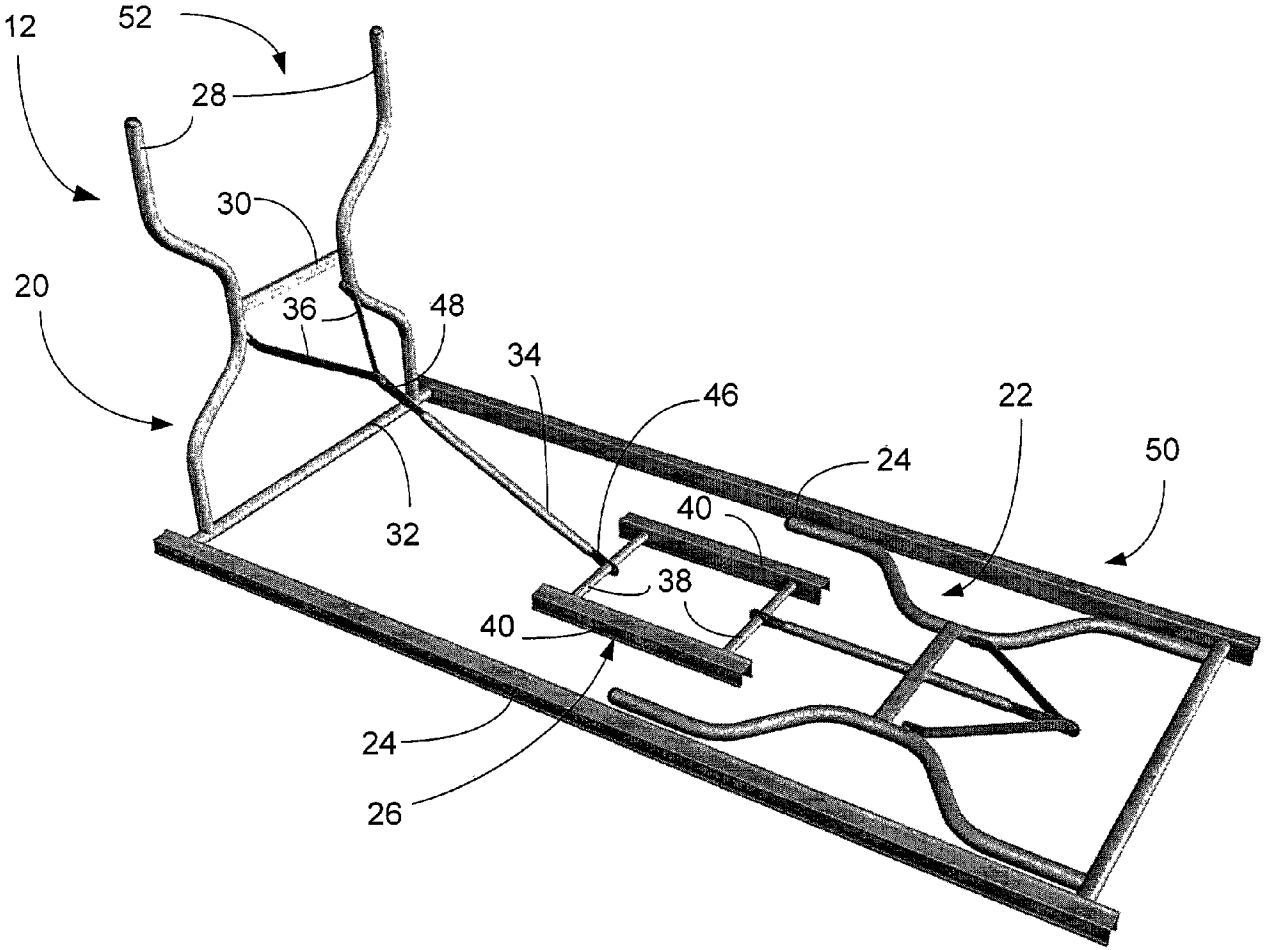
FIG. 3 shows a bottom perspective view of the frame of the present invention.
Figure 4:
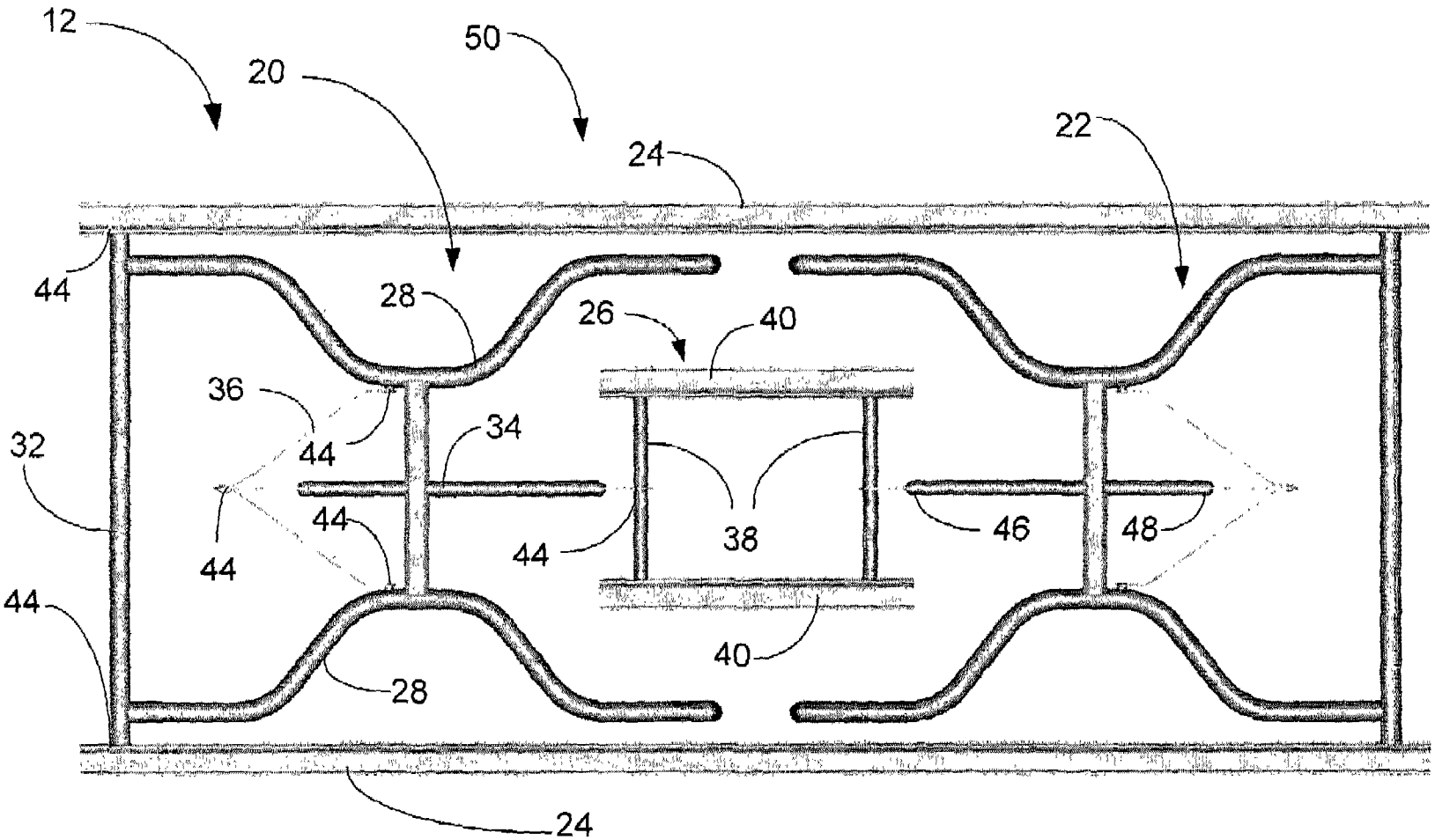
FIG. 4 illustrates a bottom plan view of the frame of the present invention.
Figure 5:
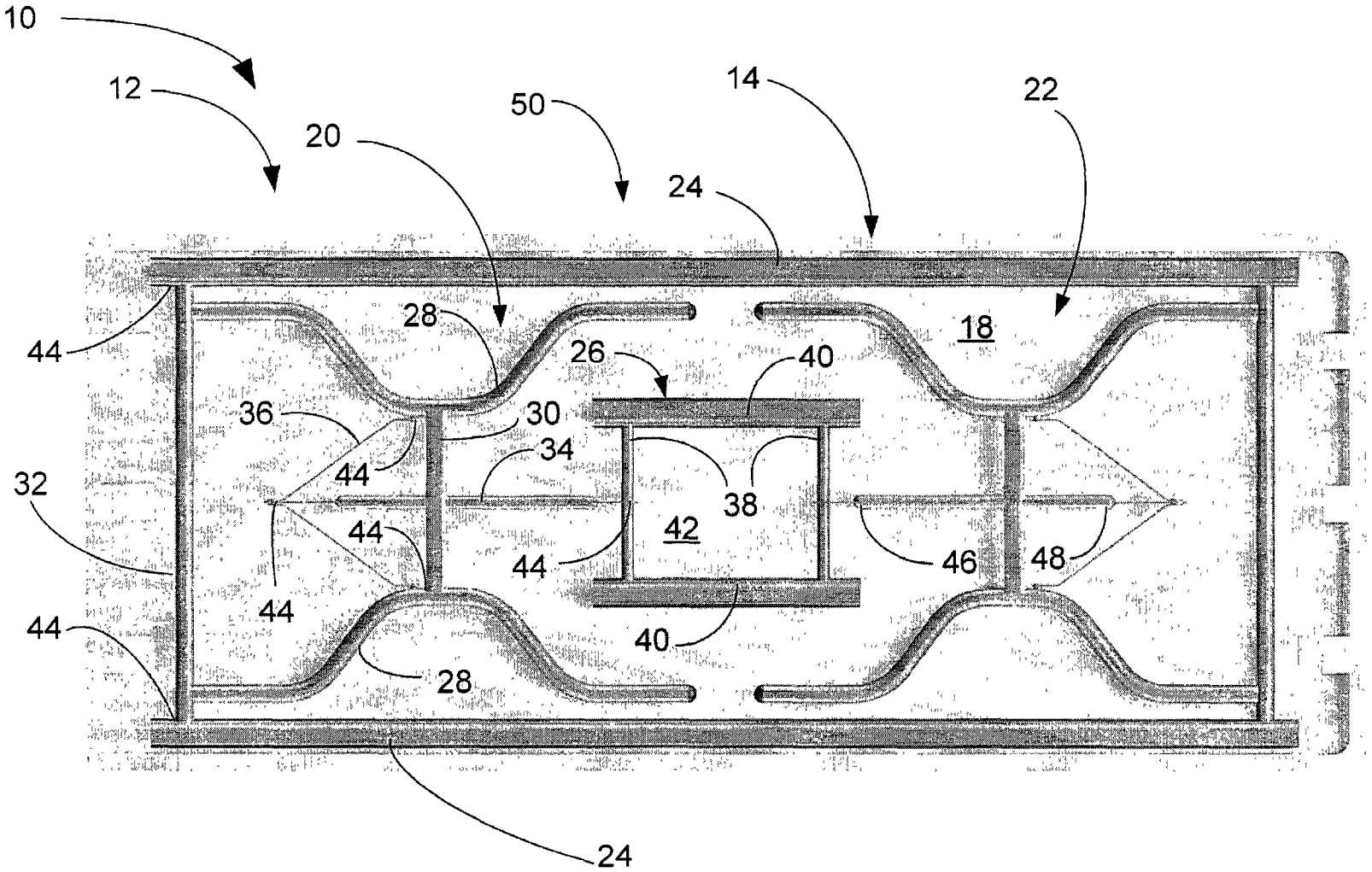
FIG. 5 shows a bottom plan view of the table.

The support frame 12 can be more easily seen in FIGS. 2–5, which include detail perspective and bottom plan views of the frame 12 alone in FIGS. 3 and 4, and a bottom plan view of the frame 12 and the underside 18 of the table 10 in FIG. 5. The support frame 12 generally includes a first leg assembly 20 and a second leg assembly 22, two side rails 24, and a central support/pivot assembly 26. Each leg assembly 20, 22 is preferably identical and includes two legs 28, a cross-bar 30, a transverse bar 32, a brace 34 and preferably a pair of connecting members 36. The braces 34 each have an end closer to the center of the table 10, which will be referred to as the inner end 46, and an end closer to the legs 28, which will be referred to as the outer end 48.

The support frame 12 as a whole can be divided generally into a perimeter frame 41, including the first leg assembly 20 and second leg assembly 22, and side rails 24, which are located closer to the perimeter of the table top 14, and the central support/pivot assembly 26, which is closer to the center of the table top 14. The perimeter frame 41 and the central support/pivot assembly 26 are coupled together by the braces 34.

The central support/pivot assembly 26 can also be thought of as a "floating central assembly" 27 with regard to the perimeter frame 41, since this assembly is preferably not attached to the side rails 24. The floating central assembly 27 is however, preferably attached to protrusions 56 or otherwise fixed to the underside of the table surface 18.

A preferred embodiment of the central support/pivot assembly 26, or floating central assembly 27, preferably includes two cross members 38 and two anchor rails 40. This structure will be referred to as an "II structure" 29. This floating central assembly 27 can take various forms, of which the II structure 29 shown is only one. Other obvious variations are an "I" structure, having one cross member, an "III" structure having three cross members, etc. It is also possible that the floating central assembly 27 be a flat plate without cross bars at all, with pivot attachments of any geometric shape. Or it may be a box structure, dome, etc. Many variations on this design will be obvious to one skilled in the art, and are contemplated by the present invention.

In the preferred embodiment, the anchor rails are attached to the central region 42 of the table lower surface 18 (see especially FIG. 5). The cross members 38 provide attachment and pivot axels for the braces 34.

There are a number of pivots 44, by which the transverse bars 32 are pivotally attached to the rails 24. The connecting members 36 are pivotally attached to the legs 28, and to the outer end 48 of the brace 34. The inner end 46 of each of the braces 34 is also pivotally attached to the cross member 38 of the central support/pivot assembly 26.

Besides providing pivot attachments for the legs, the braces 34 also provide a limit to the travel of the legs 28 when they go from the collapsed configuration 50 to an extended configuration 52.

The central support/pivot assembly 26 provides important support for the central area 42 of the table 10 (see FIG. 5). By enclosing a rectangular area, it supports a much larger portion of the table top 14 than a single or even multiple cross-bars.

The table top 14 is preferably formed of blow-molded plastic, which provides a sturdy but very light-weight surface. The blow-molded plastic is capable of formed with any number of protrusions or other features to which attachment of the support frame 12 can be achieved. One representative scheme for attaching the frame to the table top 14 is shown in FIG. 2, where a raised rim 54 and a number of protrusions 56 have been fashioned. The support frame 12 is thus attached to table top 14 by fasteners of any conventional variety. It will be obvious to one skilled in the art that many different contours of the table lower surface 18 and methods of attachment may be used, and are contemplated by the present invention 10.

Figure 6:
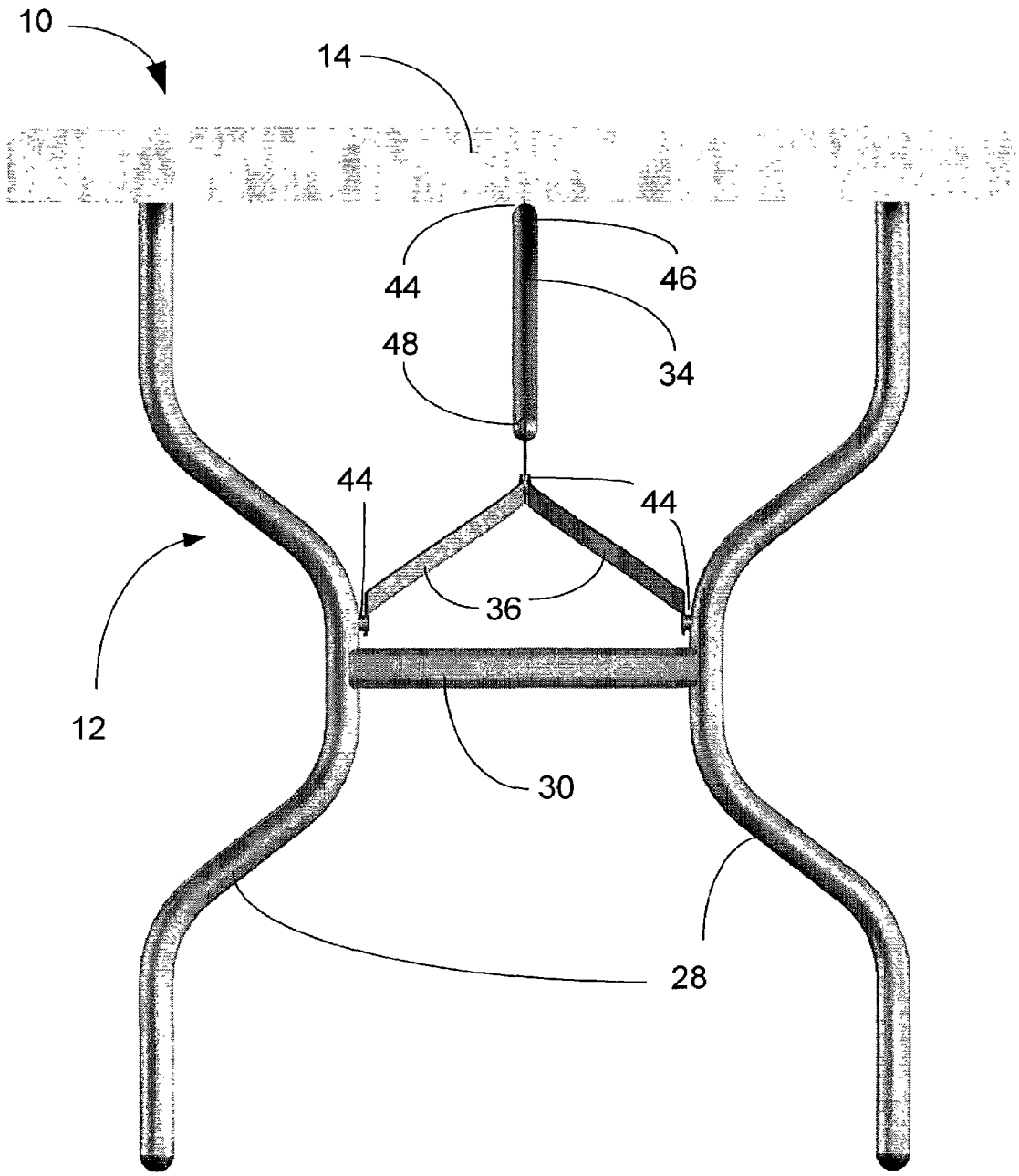
FIG. 6 shows an end plan view of the table.

FIG. 6 shows an end plan view of the table 10, again showing the table top 14, legs 28, cross bar 30, connecting members 36, brace 34 and pivots 44.

Figure 7:
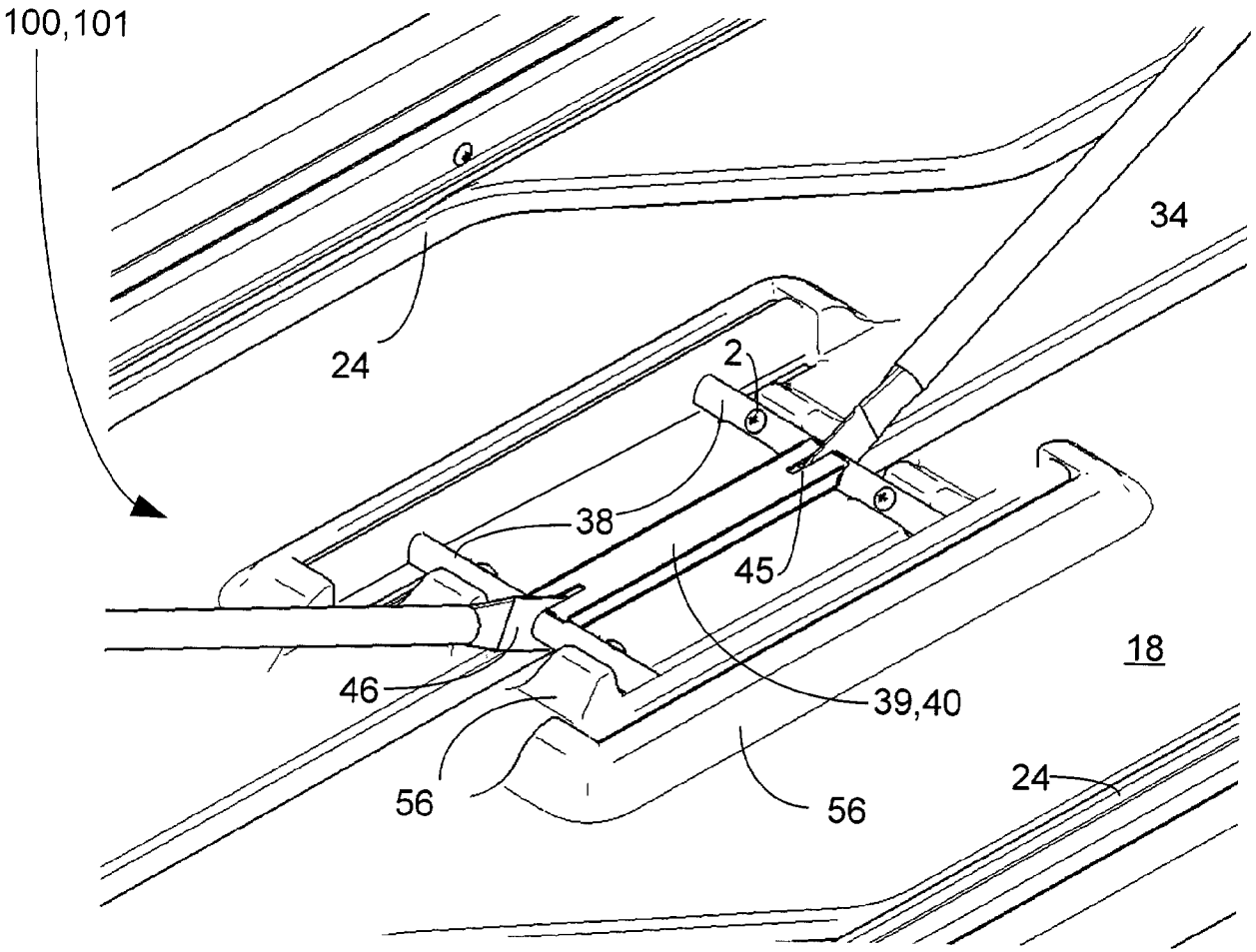
FIG. 7 illustrates a bottom perspective view of a second embodiment of the floating central assembly of the present invention.
Figure 8:
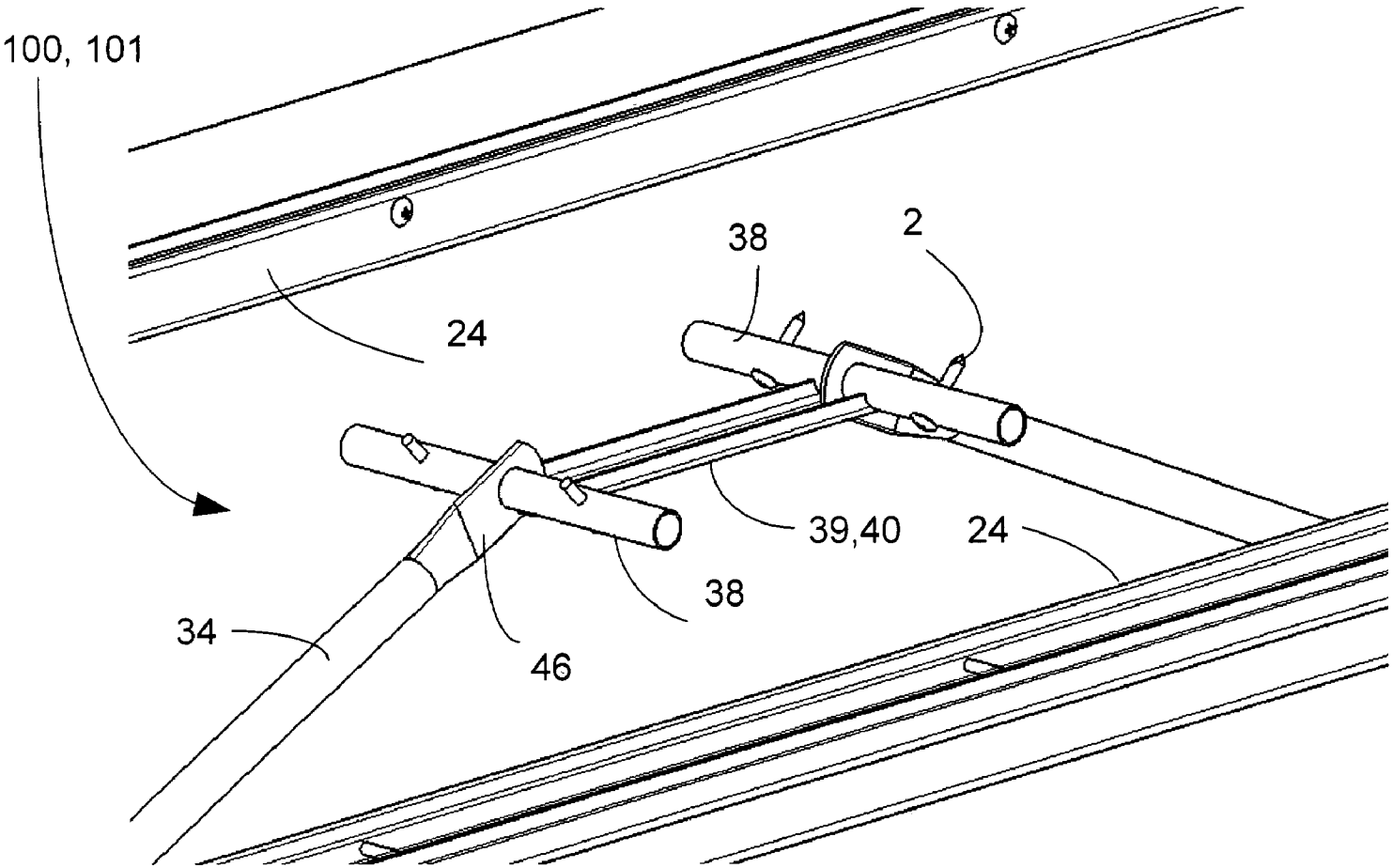
FIG. 8 shows a top perspective view of the second embodiment of the floating central assembly of the present invention.
Figure 9:
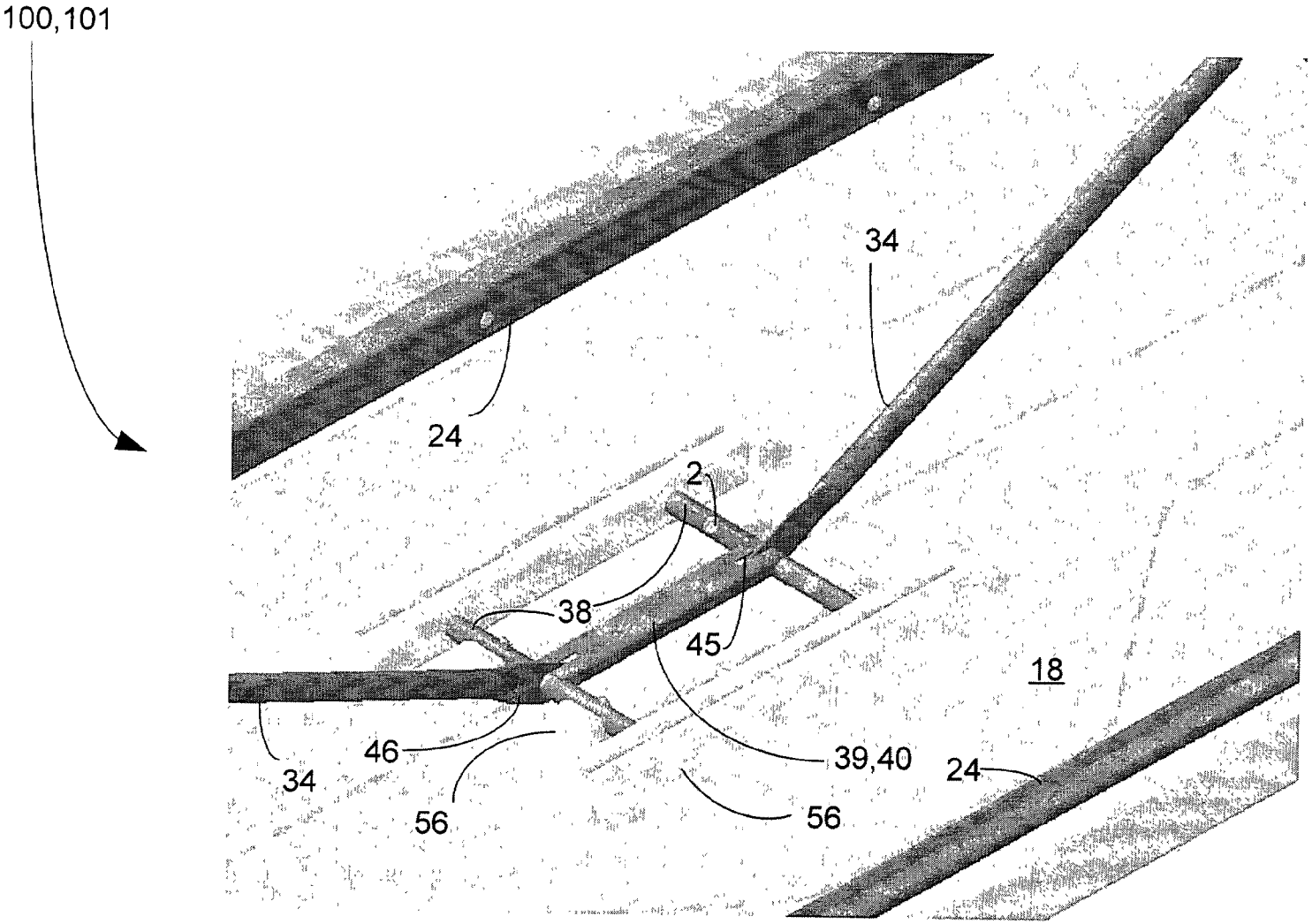
FIG. 9 shows a bottom perspective view of the second embodiment of the floating central assembly of the present invention with the table in place.

FIGS. 7–9 show a second embodiment of folding table having a variation in the structure of the central support/pivot assembly, which will be designated by the reference number 100. This structure can be thought of as an "H" structure 101, and as before, its central support/pivot assembly 26 is a form of floating central assembly 27. As before, it preferably has two cross members 38 to which the brace inner ends 46 of the braces 34 are pivotally attached. However, there is only a single anchor rail 40, which will be referred to as a center anchor rail 39, preferably including pivot slots 45 through which the brace inner ends 46 engage the cross members 38.

Protrusions 56 in the table lower surface 18 may be configured differently than in the earlier embodiment in order to allow the central support/pivot assembly 26 to attach firmly. Fasteners 2 such as screws are preferably used to attach the central support/pivot assembly 26 to the table lower surface 18.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

INDUSTRIAL APPLICABILITY

The present folding table 10 is well suited for application for providing a support surface by providing an expansive table surface, and yet collapsing to a very small volume for storage. Folding tables have traditionally been used at social functions and church socials because of their capacious size when erected, and their compact size when folded for storage. Such tables naturally have competing goals of providing stability and the goal to minimize weight. Older tables used particle board or masonite which tended towards sturdy construction, but at the expense of weight. More recently, tables have been constructed of blow-molded materials with a metal frame leg assembly attached to its underside. Although these tables are often light weight and very portable, they may have a tendency to sag if there is not proper support in the center of the surface, since the blow-molded surface is somewhat flexible. The present invention 10 overcomes these difficulties by providing a central support/pivot assembly 26 which can also be thought of as a "floating central assembly" 27.

The folding table 10 generally includes a support frame 12 and a table top 14 having an upper surface 16 and a lower surface 18. The support frame 12 includes a first leg assembly 20 and a second leg assembly 22, two side rails 24, and a central support/pivot assembly 26. Each leg assembly 20, 22 is preferably identical and includes two legs 28, a cross-bar 30, a transverse bar 32, a brace 34 and preferably a pair of connecting members 36.

A preferred embodiment of the central support/pivot assembly 26 preferably includes two cross members 38 and at least one anchor rail 40, which could be a central anchor rail 39. This floating central assembly 27 can take various forms, of which the II structure 29 is one and the H structure 101 is another.

In the preferred embodiment, the anchor rails are attached to the central region 42 of the table lower surface 18. The cross members 38 provide attachment and pivot axels for the braces 34. There are a number of pivots 44, by which the transverse bars 32 are pivotally attached to the rails 24. The connecting members 36 are pivotally attached to the legs 28, and to the outer end 48 of the brace 34. The inner end 46 of each of the braces 34 is also pivotally attached to the cross member 38 of the central support/pivot assembly 26.

The central support/pivot assembly 26 provides important support for the central area 42 of the table 10. By enclosing a rectangular area, it supports a much larger portion of the table top 14 than a single or even multiple cross-bars.

For the above, and other, reasons, it is expected that the air bed with elevated and self-expanding support structure 10, 100 of the present invention will have widespread industrial applicability. Therefore, it is expected that the commercial utility of the present invention will be extensive and long lasting.

What is claimed is:

1. A table comprising:

a table top including a top portion, a bottom portion and an outer perimeter;

a first projection integrally formed in the bottom portion of the table top, the first projection positioned proximate a generally central portion of the table top and positioned at least substantially away from the outer perimeter of the table top;

a second projection integrally formed in the bottom portion of the table top, the second projection positioned proximate the generally central portion of the table top and positioned at least substantially away from the outer perimeter of the table top;

a first frame member including at least a portion positioned proximate the outer perimeter of the table top;

a second frame member including at least a portion positioned proximate the outer perimeter of the table top;

a first leg assembly pivotally attached to the first frame member and pivotally attached to the second frame member, the first leg assembly being movable between a use position and a storage position;

a second leg assembly pivotally attached to the first frame member and pivotally attached to the second frame member, the second leg assembly being movable between a use position and a storage position;

a pivot assembly positioned proximate the generally central portion of the table top and positioned at least substantial distance away from the outer perimeter of the table top, the pivot assembly connected to the first projection and to the second projection, the pivot assembly comprising:

a first pivot bar; and a second pivot bar;

a first support assembly comprising:

a first brace structure pivotally connected to the first leg assembly, the first brace structure including a first pair of brackets; and a first support bar pivotally connected to the first brace structure and pivotally connected to the first pivot bar; and a second support assembly comprising:

a second brace structure pivotally connected to the second leg assembly, the second brace structure including a second pair of brackets; and a second support bar pivotally connected to the second brace structure and pivotally connected to the second pivot bar.

2. The table as in claim 1, wherein the pivot assembly further comprises a pair of rails connecting the first and second pivot bars to the first and second projections.

3. The table as in claim 1, further comprising a generally downwardly extending lip integrally formed in the table top.

4. The table as in claim 3, wherein the first projection is positioned at least substantially away from the lip and wherein the second projection is positioned at least substantially away from the lip.

5. The table as in claim 3, wherein the pivot assembly is positioned at least substantially away from the lip.

6. The table as in claim 1, wherein the first projection is positioned at least substantially away from the first and second frame members; and wherein the second projection is positioned at least substantially away from the first and second frame members.

7. The table as in claim 1, wherein the pivot assembly is positioned at least substantially away from the first and second frame members.

8. A table comprising:

a table top including a top portion and a bottom portion;

a table frame connected to the table top, the table frame including a first elongated frame member and a second elongated frame member;

a first elongated projection integrally formed in the bottom portion of the table top, the first elongated projection being generally aligned parallel to the first elongated frame member and to the second elongated frame member;

a second elongated projection integrally formed in the bottom portion of the table top, the second elongated projection being generally aligned parallel to the first elongated frame member and to the second elongated frame member;

a first leg assembly pivotally attached to the table frame, the first leg assembly including at least one leg movable between a use position and a storage position;

a second leg assembly pivotally attached to the table frame, the second leg assembly including at least one leg movable between a use position and a storage position;

a first elongated pivot bar spaced apart from the table frame, the first pivot bar connected to the first projection and to the second projection;

a second elongated pivot bar spaced apart from the table frame, the second pivot bar connected to the first projection and to the second projection;

a first support assembly pivotally connected to the first leg assembly and pivotally connected to the first pivot bar; and a second support assembly pivotally connected to the second leg assembly and pivotally connected to the second pivot bar.

9. The table as in claim 8, wherein the pivot assembly further comprises a pair of rails connecting the first and second pivot bars to the first and second projections.

10. The table as in claim 8, wherein the first elongated pivot bar is generally aligned perpendicular to the first elongated frame member and to the second elongated frame member; and wherein the second elongated pivot bar is generally aligned perpendicular to the first elongated frame member and to the second elongated frame member.

11. The table as in claim 8, wherein the first elongated pivot bar is generally aligned perpendicular to the first elongated projection and to the second elongated projection; and wherein the second elongated pivot bar is generally aligned perpendicular to the first elongated projection and to the second elongated projection.

12. A table comprising:

a table top including a top portion and a bottom portion;

a table frame connected to the table top, the table frame including a first frame member and a second frame member;

a first pivot bar including a first end portion and a second end portion, the first end portion and the second end portion being spaced apart from the first frame member and the second frame member; and a second pivot bar including a first end portion and a second end portion, the first end portion and the second end portion being spaced apart from the first frame member and the second frame member;

a first projection integrally formed in the bottom portion of the table top, at least a portion of the first projection being disposed between the first frame member and the first end portion of the first pivot bar, at least a portion of the first projection being disposed between the first frame member and the second end portion of the first pivot bar, at least a portion of the first projection being disposed between the first frame member and the first end portion of the second pivot bar, and at least a portion of the first projection being disposed between the first frame member and the second end portion of the second pivot bar;

a second projection integrally formed in the bottom portion of the table top, at least a portion of the second projection being disposed between the second frame member and the first end portion of the first pivot bar, at least a portion of the second projection being disposed between the second frame member and the second end portion of the first pivot bar, at least a portion of the second projection being disposed between the second frame member and the first end portion of the second pivot bar, and at least a portion of the second projection being disposed between the second frame member and the second end portion of the second pivot bar;

a first leg assembly including at least one leg;

a second leg assembly including at least one leg;

a first support assembly pivotally connected to the first leg assembly and pivotally connected to the first pivot bar; and a second support assembly pivotally connected to the second leg assembly and pivotally connected to the second pivot bar.

13. The table as in claim 12, further comprising a pair of rails connecting the first and second pivot bars to the first and second projections.

14. A table comprising:

a table top including a top portion and a bottom portion;

a generally downwardly extending lip integrally formed in the table top, the lip comprising:

a first elongated portion;

a second elongated portion;

a first end portion extending between the first elongated portion and the second elongated portion; and a second end portion extending between the first elongated portion and the second elongated portion;

a first pivot bar spaced apart from the lip, the first pivot bar including a first end portion and a second end portion; and a second pivot bar spaced apart from the lip, the second pivot bar including a first end portion and a second end portion;

a first projection integrally formed in the bottom portion of the table top, at least a portion of the first projection being disposed between the first elongated portion of the lip and the first end portion of the first pivot bar, at least a portion of the first projection being disposed between the first elongated portion of the lip and the second end portion of the first pivot bar, at least a portion of the first projection being disposed between the first elongated portion of the lip and the first end portion of the second pivot bar, and at least a portion of the first projection being disposed between the first elongated portion of the lip and the second end portion of the second pivot bar;

a second projection integrally formed in the bottom portion of the table top, at least a portion of the second projection being disposed between the second elongated portion of the lip and the first end portion of the first pivot bar, at least a portion of the second projection being disposed between the second elongated portion of the lip and the second end portion of the first pivot bar, at least a portion of the second projection being disposed between the second elongated portion of the lip and the first end portion of the second pivot bar, and at least a portion of the second projection being disposed between the second elongated portion of the lip and the second end portion of the second pivot bar;

a first leg assembly including at least one leg;

a second leg assembly including at least one leg;

a first support assembly pivotally connected to the first leg assembly and pivotally connected to the first pivot bar; and a second support assembly pivotally connected to the second leg assembly and pivotally connected to the second pivot bar.

15. The table as in claim 14, further comprising a pair of rails connecting the first and second pivot bars to the first and second projections.

16. A table comprising:

a table top including a top portion and a bottom portion;

a first leg assembly including at least one leg and a second leg, the first and second legs being movable between a use position and a storage position;

a second leg assembly including a third leg and a fourth leg, the third and fourth legs being movable between a use position and a storage position;

a first pivot bar including a first end portion and a second end portion, the first and second end portions of the first pivot bar being spaced apart from the first, second, third and fourth legs when the legs are in the storage position;

a second pivot bar including a first end portion and a second end portion, the first and second end portions of the second pivot bar being spaced apart from the first, second, third and fourth legs when the legs are in the storage position;

a first projection integrally formed in the bottom portion of the table top, the first projection being connected to the first pivot bar and connected to the second pivot bar;

a second projection integrally formed in the bottom portion of the table top, the second projection being connected to the first pivot bar and connected to the second pivot bar;

a first support assembly pivotally connected to the first leg assembly and pivotally connected to the first pivot bar;

a second support assembly pivotally connected to the second leg assembly and pivotally connected to the second pivot bar;

at least a portion of the first projection being disposed between the first leg in the storage position and the first end portion of the first pivot bar, at least a portion of the first projection being disposed between the first leg in the storage position and the second end portion of the first pivot bar;

at least a portion of the second projection being disposed between the second leg in the storage position and the first end portion of the first pivot bar, at least a portion of the second projection being disposed between the first leg in the storage position and the second end portion of the first pivot bar;

at least a portion of the first projection being disposed between the third leg in the storage position and the first end portion of the second pivot bar, at least a portion of the first projection being disposed between the third leg in the storage position and the second end portion of the second pivot bar; and at least a portion of the second projection being disposed between the fourth leg in the storage position and the first end portion of the second pivot bar, at least a portion of the second projection being disposed between the fourth leg in the storage position and the second end portion of the second pivot bar.

17. The table as in claim 16, further comprising a pair of rails connecting the first and second pivot bars to the first and second projections.

18. A table comprising:

a table top including a top portion and a bottom portion;

a table frame connected to the table top, the table frame including a first frame member and a second frame member;

a first leg assembly including a first leg and a second leg, the first and second legs being movable between a use position and a storage position;

a second leg assembly including a third leg and a fourth leg, the third and fourth legs being movable between a use position and a storage position;

a first bar including a first portion, a second portion and a generally cylindrical cross-sectional configuration extending between the first portion and the second portion, the first bar being spaced apart from the first, second, third and fourth legs when the legs are in the storage position;

a second bar including a first portion, a second portion and a generally cylindrical cross-sectional configuration extending between the first portion and the second portion, the second bar being spaced apart from the first, second, third and fourth legs when the legs are in the storage position;

a first support assembly connected to the first leg assembly and connected to the first bar;

a second support assembly connected to the second leg assembly and connected to the second bar;

at least a portion of the first leg in the storage position being disposed between the first frame member and the first portion of the first bar, at least a portion of the first leg in the storage position being disposed between the first frame member and the second portion of the first bar;

at least a portion of the second leg in the storage position being disposed between the second frame member and the first portion of the first bar, at least a portion of the second leg in the storage position being disposed between the second frame member and the second portion of the first bar;

at least a portion of the third leg in the storage position being disposed between the first frame member and the first portion of the second bar, at least a portion of the third leg in the storage position being disposed between the first frame member and the second portion of the second bar; and at least a portion of the fourth leg in the storage position being disposed between the second frame member and the first portion of the second bar, at least a portion of the fourth leg in the storage position being disposed between the second frame member and the second portion of the second pivot bar.

19. The table as in claim 18, wherein the first and second portions of the first bar are spaced apart from the table frame; and wherein the first and second portions of the second bar are spaced apart from the table frame.

20. A table comprising:

a table top including a top portion and a bottom portion;

a table frame connected to the table top, the table frame including a first frame member and a second frame member;

a first leg assembly including a first leg and a second leg, the first and second legs being movable between a use position and a storage position;

a second leg assembly including a third leg and a fourth leg, the third and fourth legs being movable between a use position and a storage position;

a first bar including a first portion, a second portion and a generally consistent cross sectional configuration extending between the first portion and the second portion, the first and second portions of the first bar being spaced apart from the first, second, third and fourth legs when the legs are in the storage position;

a second bar including a first portion, a second portion and a generally consistent cross sectional configuration extending between the first portion and the second portion, the first and second portions of the second bar being spaced apart from the first, second, third and fourth legs when the legs are in the storage position;

a first support assembly connected to the first leg assembly and connected to the first bar;

a second support assembly connected to the second leg assembly and connected to the second bar;

at least a portion of the first leg in the storage position being disposed between the first frame member and the first portion of the first bar, at least a portion of the first leg in the storage position being disposed between the first frame member and the second portion of the first bar;

at least a portion of the second leg in the storage position being disposed between the second frame member and the first portion of the first bar, at least a portion of the second leg in the storage position being disposed between the second frame member and the second portion of the first bar;

at least a portion of the third leg in the storage position being disposed between the first frame member and the first portion of the second bar, at least a portion of the third leg in the storage position being disposed between the first frame member and the second portion of the second pivot bar; and at least a portion of the fourth leg in the storage position being disposed between the second frame member and the first portion of the second bar, at least a portion of the fourth leg in the storage position being disposed between the second frame member and the second portion of the second bar.

21. The table as in claim 20, wherein the first and second portions of the first bar are spaced apart from the table frame; and wherein the first and second portions of the second bar are spaced apart from the table frame.

22. The table as in claim 20, wherein the first bar has a generally circular-shaped cross sectional configuration.

23. A table comprising:

a table top including a top portion and a bottom portion;

a table frame connected to the table top, the table frame including a first frame member and a second frame member;

a first bar including a first portion, a second portion and a generally consistent cross sectional configuration extending between the first portion and the second portion, the first portion of the first bar being spaced closer to the first frame member than to the second frame member, the second portion of the first bar being spaced closer to the second frame member than to the first frame member, the first portion of the first bar being spaced apart from the first frame member by a first gap, the second portion of the first bar being spaced apart from the second frame member by a second gap;

a second bar including a first portion, a second portion and a generally consistent cross sectional configuration extending between the first portion and the second portion, the first portion of the second bar being spaced closer to the first frame member than to the second frame member, the second portion of the second bar being spaced closer to the second frame member than to the first frame member, the first portion of the second bar being spaced apart from the first frame member by a third gap, the second portion of the second bar being spaced apart from the second frame member by a fourth gap;

a first leg assembly including a first leg and a second leg, the first and second legs being movable between a use position and a storage position;

a second leg assembly including a third leg and a fourth leg, the third and fourth legs being movable between a use position and a storage position;

a first support assembly connected to the first leg assembly and connected to the first bar;

a second support assembly connected to the second leg assembly and connected to the second bar;

at least a portion of the first leg in the storage position being disposed within the first gap;

at least a portion of the second leg in the storage position being disposed within the second gap at least a portion of the third leg in the storage position being disposed within the third gap; and at least a portion of the fourth leg in the storage position being disposed within the fourth gap.

24. The table as in claim 23, wherein the first bar is aligned in generally the same plane as the first and second frame members; and wherein the second bar is aligned in generally the same plane as the first and second frame members.

* * * * *

UNITED STATES PATENT AND TRADEMARK OFFICE

CERTIFICATE OF CORRECTION

PATENT NO. : 6,968,789 B2
APPLICATION NO. : 10/315290
DATED : November 29, 2005
INVENTOR(S) : Kwang-Ho Baik and Jeffrey A. Fox It is certified that error appears in the above-identified patent and that said Letters Patent is hereby corrected as shown below:

Cover Page
Item (57), line 5, after "to said" remove [the]

Column 1
Line 57, after "to said" remove [the]

Column 3
Line 2, remove [27]
Line 4, remove [27]
Line 8, remove [27]
Line 10, remove [29]
Line 11, remove [27]
Line 12, remove [29]
Line 15, remove [27]
Line 42, before "formed" insert --being--

Column 4
Line 36, remove [27]
Line 48, remove [27]
Line 49, remove [29]

Signed and Sealed this

Twenty-fifth Day of July, 2006

JON W. DUDAS
*Director of the United States Patent and Trademark Office*